US010711591B2

(12) United States Patent
Berzanskis et al.

(10) Patent No.: US 10,711,591 B2
(45) Date of Patent: Jul. 14, 2020

(54) SENSING UMBILICAL

(71) Applicant: MAGIQ TECHNOLOGIES, INC., Somerville, MA (US)

(72) Inventors: Audrius Berzanskis, Boston, MA (US); Matthew T Begg, Norwood, MA (US); Larry Allan Walter, Conroe, TX (US); Scott Michael John Taylor, Houston, TX (US)

( * ) Notice: Subject to any disclaimer, the term of this patent is extended or adjusted under 35 U.S.C. 154(b) by 245 days.

(21) Appl. No.: 15/246,505

(22) Filed: Aug. 24, 2016

(65) Prior Publication Data

US 2017/0152738 A1 Jun. 1, 2017

Related U.S. Application Data

(60) Provisional application No. 62/184,236, filed on Jun. 24, 2015.

(51) Int. Cl.

| | |
|---|---|
| ***E21B 47/01*** | (2012.01) |
| ***E21B 47/06*** | (2012.01) |
| ***E21B 47/12*** | (2012.01) |
| ***E21B 17/20*** | (2006.01) |

(52) U.S. Cl.
CPC ..... *E21B 47/011* (2013.01); *E21B 17/206* (2013.01); *E21B 47/06* (2013.01); *E21B 47/123* (2013.01)

(58) Field of Classification Search
None
See application file for complete search history.

(56) References Cited

U.S. PATENT DOCUMENTS

| | | | | |
|---|---|---|---|---|
| 6,131,658 A * | 10/2000 | Minear | ..... | E21B 17/1028 166/250.01 |
| 8,925,627 B2 * | 1/2015 | Tupper | ..... | E21B 17/20 166/302 |
| 2014/0199775 A1 * | 7/2014 | Bagley | ..... | C09D 5/08 436/163 |

* cited by examiner

*Primary Examiner* — Daniel S Larkin

(57) ABSTRACT

An umbilical having a plurality of sensors (single, multi-component, or distributed) disposed in a sealed encapsulant, optionally with "accessories" or connectors at the ends, and the methods or manufacturing and deploying such an umbilical for seismic imaging in geological formations and other applications.

10 Claims, 4 Drawing Sheets

FIG. 1B – PRIOR ART

SENSING UMBILICAL

CROSS-REFERENCE TO RELATED APPLICATIONS

This application claims priority to and the benefit of U.S. Provisional Patent Application No. 62/184,236, filed on Jun. 24, 2015, which is hereby incorporated herein by reference in its entirety.

TECHNICAL FIELD

Embodiments of the present invention relate generally to systems and methods for deploying sensors in subterranean environments, and, more particularly, to an umbilical equipped with sensors for use in borehole operations and other applications.

BACKGROUND

Current applications in the field of seismic monitoring and imaging use modular and discrete sensor "sondes" interconnected by cable or ridged pipe containing analog or telemetry conductors. These sensor arrays must typically be deployed in protected wellbores, and often experience failures in interconnections, fluid intrusions, and other mechanical disruptions. The complexity, unreliability, and cost of these conventional systems often precludes commercially-viable permanent, semi-permanent, or long-term applications of the technology.

Coiled tubing, widely used in the oil and gas industry, is typically used in oilfield intervention products for delivering fluids and flow conduits into wellbores. Such tubing is typically made of steel but may be made of other metals or composites depending on the chemical contents of the wells where it will be used. Coiled tubing can be rolled up onto a "spool" for transportation and then subsequently "injected" into an oil well.

Individual sensing devices have been deployed in coiled tubing with a wireline or other communication channel internal to the coiled tubing, with the sensors recording information as they move up and down the well. However, this arrangement does not allow for mapping the subsurface beyond the immediate area around the wellbore.

Coiled tubing has been used with sonde-based sensors for seismic surveys, but has not achieved popularity due to the difficulty and expense of getting an array of traditional wireline sensors into coiled tubing and back out again for servicing.

Thus, there is a need in the art for sensors suited to deployment in coiled tubing and wellbore environments that overcome the disadvantages of conventional approaches identified above.

SUMMARY

This summary is provided to introduce a selection of concepts in a simplified form that are further described below in the Detailed Description section. This summary is not intended to identify key features or essential features of the claimed subject matter, nor is it intended to be used as an aid in determining the scope of the claimed subject matter.

The embodiments of the present invention disclosed herein address the above-mentioned disadvantages and pertain to the deployment of sensors in wellbores and coiled tubing and packaging and installation techniques to place them therein. These sensors may be used for, e.g., seismic imaging downhole and buried near-surface, using large-aperture arrays of multi-component or distributed fiber optic sensors incorporated into an sealed enclosure, such as the umbilical cable discussed herein.

Generally, in various embodiments and implementations, embodiments of the present invention use a plurality of sensors (single, multi-component, or distributed) disposed in a continuously sealed encapsulant, optionally with "accessories" or connectors at the ends, and the methods for manufacturing and using such an umbilical. When implemented as described herein, the present invention is safe, environmentally secure, and offers cost effective deployment and operation of spatially dense, large-aperture vertical and/or horizontal seismic sensor arrays for seismic imaging in geological formations and other applications. One advantage of the umbilical form factor is it can be deployed using standard cable handling equipment because of its uniform diameter and sufficient flexibility.

Once encapsulated in an umbilical, these sensors can be deployed inside existing producing wellbores (even in the presence of an environmental seal); in the annular space between the drilled wellbore and the production casing(s); and into purpose drilled and uncased instrumentation wells.

The umbilical may also be loaded into coiled tubing, where the common linear dimensions of the umbilical provide for safe and controlled pressurized wellbore entry thru conventional grease-head or tubing packers as needed. The small outside dimensions possible with coiled tubing allow practical deployments of tens to thousands of sensors at chosen intervals to depths and horizontal extents limited only by the common handling injectors and infrastructure of commercial coiled-tubing services. Embodiments of the present invention are suitable for both on-shore and off-shore downhole applications.

In one aspect, embodiments of the present invention relate to a sensing umbilical for use in a borehole, the umbilical comprising a core having at least one sensor; at least one supporting connection for the at least one sensor; and an encapsulant external to the core.

In one embodiment, the diameter of the core is approximately the size of the at least one sensor.

In one embodiment, the at least one supporting connection is at least one of an electrical connection and an optical connection.

In one embodiment, the at least one supporting connection is contained in a conduit or capillary.

In one embodiment, the umbilical further comprises at least one external layer external to the encapsulant. In one embodiment, the umbilical further comprises at least one sensing fiber located in at least one of the encapsulant and the at least one external layer.

In one embodiment, the core is fabricated from a material selected from the group consisting of plastic, aramid, carbon fiber, fiberglass, and steel.

In one embodiment, the encapsulant is transparent.

In one embodiment, the at least one sensor is a plurality of sensors, at least some of the plurality of sensors interconnected by mounts that allow flexion but not rotation.

In one embodiment, the at least one sensor is attached to the core with at least one mount point.

In one embodiment, the at least one sensor is an array of seismic sensors.

In another aspect, embodiments of the present invention relate to a method of fabricating a sensing umbilical, the method comprising receiving a core encapsulated in an encapsulant, the encapsulant having at least one supporting connection for at least one sensor; cutting the encapsulant to access the core; adding at least one sensor to the core; and closing the cut encapsulant.

In one embodiment, adding at least one sensor to the core comprises mounting the at least one sensor in the core; and splicing the at least one sensor into the at least one supporting connection. In one embodiment, adding at least one sensor to the core further comprises at least one of potting the at least one sensor and injection molding the at least one sensor in place. In one embodiment, adding at least one sensor to the core further comprises removing part of the core to form a space for receiving the at least one sensor.

In one embodiment, the method further comprises adding at least one external layer external to the encapsulant.

In one embodiment, the method further comprises injecting the closed umbilical equipped with the at least one sensor into coiled tubing. In one embodiment, the method further comprises injecting a filler into the space between the closed umbilical and the coiled tubing containing it. In one embodiment, the method further comprises installing a pressure feedthrough in the coiled tubing.

In yet another aspect, embodiments of the present invention relate to a method of fabricating a sensing umbilical, the method comprising fabricating a core, the core comprising at least one sensor; applying at least one layer of at least one of a wire, a capillary, a conduit, a fiber, a filler, a strength member, an encapsulant, a tape, an armor, and a yarn over the core; and splicing at least one of an applied wire, an applied capillary, an applied conduit and an applied fiber to at least one sensor in the core.

In one embodiment, the method further comprising inserting the umbilical in coiled tubing.

Any combination and permutation of embodiments is envisioned. Other objects and features will become apparent from the following detailed description considered in conjunction with the accompanying drawings. It is to be understood, however, that the drawings are designed as an illustration only and not as a definition of the limits of the present disclosure.

BRIEF DESCRIPTION OF THE DRAWINGS

Exemplary embodiments of the present disclosure will be understood from the following detailed description when read with the accompanying Figures. In the drawings, like reference numerals refer to like parts throughout the various views of the non-limiting and non-exhaustive embodiments of the present invention, and wherein:

FIG. 1B shows a side view of prior art coiled tubing;

DETAILED DESCRIPTION

As used herein and understood by one of ordinary skill, the term "umbilical cable" or simply "umbilical" contemplates a cable which supplies required consumables to an apparatus. An umbilical can, for example, supply air and power to a pressure suit or hydraulic power, electrical power and fiber optics to subsea equipment.

As used herein and understood by one of ordinary skill, the term "conduit" contemplates a channel that can be used to carry wiring, optical fibers, etc. The term "conduit" may be used interchangeably with "pipe," "tube," "capillary," etc.

Figure 1A:
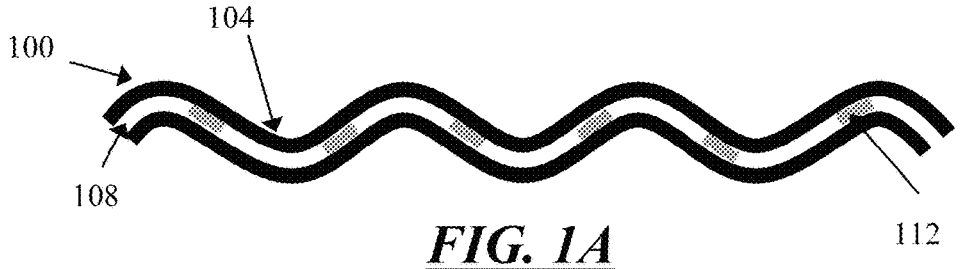
FIG. 1A shows a side view of one embodiment of a sensing umbilical.

FIG. 1A presents one embodiment of a sensing umbilical 100 in accord with the present invention. In its finished state, the umbilical 100 has one or more layers of encapsulant 104 made from, e.g., plastic, silicone, aramid, fiberglass, carbon fiber, metal, a layer of tape, etc., that encloses the various items in the umbilical 100. The umbilical 100 has a core 108 made of, e.g., plastic, silicone, aramid, carbon fiber, fiberglass, metal, etc., that serves to stiffen and give structure to the umbilical 100.

The encapsulant layers 104 may be opaque, transparent, or translucent. Transparent or translucent encapsulants permit visual inspection of the fibers, wires, etc. contained in any conduits embedded in the encapsulant (not shown in FIG. 1A). This can facilitate the embedding or maintenance of sensors, in that it permits access to the core 100 while avoiding conduits, connections, and features that would be damaged by cutting.

In various embodiments, the encapsulant layer(s) 104 around the core 108 include conduits (not shown in FIG. 1A) configured to allow fibers, wires, or fluids originating with the surface control systems to pass from one sensor 112 to another without exiting the umbilical 100 and/or being spliced, connectorized, or otherwise interrupted. Conduits may permit selective access to their contents without requiring the umbilical 100 to be cut or cut through. Conduits can be used to send fibers or wires over long distances within or the full length of the umbilical without requiring them to be spliced. Providing spare conduits in the umbilical 100 allows new wires, fibers, or hydraulics to be added as support requirements change due to, e.g., the addition of the aforementioned accessories. In various embodiments, the encapsulant layer(s) 104 may also include fibers and wires that are not in conduits.

In some embodiments, the fibers, wires, and/or conduits can be filled with or separated by filler material (e.g., plastic, silicone, aramid, fiberglass, carbon fiber, metal) so the core can be handled without crushing the fibers, wires and/or conduits when it is reeled onto the spool before moving to the next stage of the process. In these embodiments, the "encapsulant" 104 may be a layer of tape or extruded on over the filler.

The encapsulant layer(s) 104 are cut to access the core 108 to embed sensors 112. The encapsulant layer(s) 104, conduits, and any fibers or wires therein can be flexible so they can be bent outward while removing portions of the core and inserting the sensor. A layout which keeps access to the core 108 relatively clear from, e.g., two sides, may help with sensor insertion at the expense of rotational symmetry.

At various points along the length of the umbilical 100, various sensors 112 are placed. The sensors 112 may include one or more discrete seismic, acoustic, pressure, and temperature sensors. Such sensors can take the form of optically interrogated fiber Bragg gratings, optically interrogated quartz crystals, mass/spring based coiled fiber sensors, and one or more individual fibers sensitive to temperature, pressure, and vibration. Electronic sensors may also be used. Vibration absorptive materials may be used within the umbilical to improve isolation between sensors. The sensors and their support systems can be manufactured with desired stretch and compression tolerances to accommodate changes in length and diameter inherent in repeated cycles of coiling and uncoiling required for deployment.

In some embodiments, at least some of the sensors 112 are placed within spaces in the core 108 as illustrated in FIG. 1A. This may be accomplished by, e.g., removing part of the core 108 (e.g., a slice that effectively splits the core 108 or a notch that leaves part of the core 108 continuous) and embedding the sensor 112 in the space formed by removing the part of the core 108. In some embodiments, the core 108 may be formed with spaces to accommodate one or more sensors 112.

In some embodiments, the sensors 112 may be placed parallel to the core 108 in, e.g., encapsulant layer(s) 104 (see FIG. 2), at the surface of the core 108 and below the encapsulant layer(s) 104, in conduits in the encapsulant layer(s) 104 (see FIG. 2), etc., as it may be desirable to locate sensors closer to the measured stimulus and/or further away from other sensors to improve isolation.

The umbilical 100 may have a sufficiently uniform dimension to allow it to move through a grease pack or other environmental sealing device where a fluid such as water, oil, gel, plastic resin/hardener/catalyst, or silicone resin/hardener/catalyst is used to carry the umbilical into coiled tubing without the need to uncoil it first and the fluid is recovered after it exits the coiled tubing. If the diameter is not sufficiently uniform, it can be made uniform with the addition of extra amounts of encapsulant, polishing, etc.

The umbilical 100 is typically designed to stretch lengthwise, be compressed around its diameter, and be bent and straightened as the coiled tubing around it changes its shape (generally lengthening and becoming more oval), in addition to any thermal expansion/contraction and environmental pressure changes the overall assembly will experience.

FIG. 1B shows a side view of prior art coiled tubing 116 for receiving the assembled umbilical 100. Coiled tubing 116 is typically fabricated from materials such as chemically resistant steel alloys, titanium, plastic, or composites based on the particular application for deployment. The coiled tubing 116 is typically configured and/or suitable for use in a hole drilled, bored and/or dug in the ground, for example in an oil/gas well environment, and also configured and/or suitable for a seismic monitoring/observation and/or instrumentation well environment. The coiled tubing 116 is continuous, but may have joints, seams, welds, and/or splices resulting from the process of manufacturing the coiled tubing 116.

In some embodiments, the coiled tubing 116 has connectors at either end to facilitate field connections of multiple segments of otherwise continuous coiled tubing to each other, and may include feedthroughs at the interface. The coiled tubing 116 may also have welds, seams, or other surface imperfections at its ends in the area where the feedthroughs are attached, as well as for plugs or other accessories, such as sensors, tractors, packers, seismic sources, and fluid injection or sampling devices.

Figure 1C:
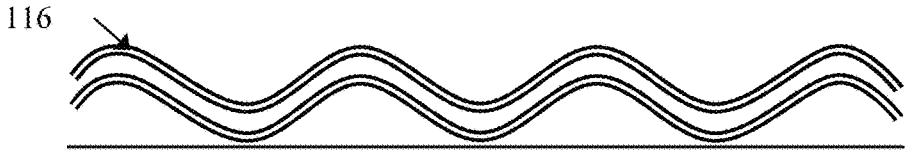
FIG. 1C shows a side view of the umbilical of FIG. 1A deployed in the coiled tubing of FIG. 1B.
Figure 1C:
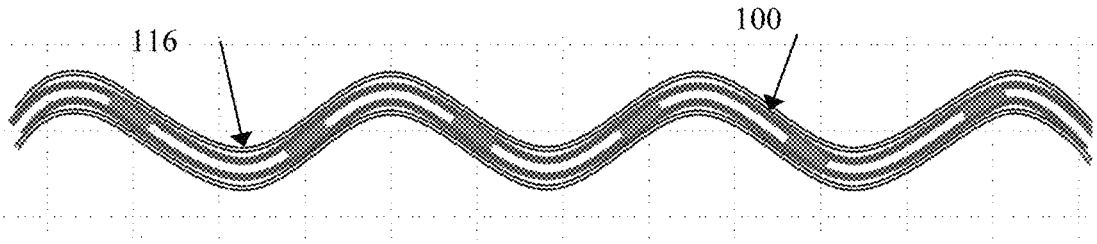

FIG. 1C is a side view of the umbilical 100 of FIG. 1A deployed in the coiled tubing 116 of FIG. 1B. The umbilical 100 is continuous and sealed from the environment by the coiled tubing 116, which is also continuous. The coiled tubing 116 optionally includes a feedthrough or connector at the top (not shown) and plug or feedthrough or connector at bottom (not shown) to prevent well fluids and gasses from escaping through the tube or damaging the sensors within it.

Filling the space between the umbilical 100 and the coiled tubing 116 may be necessary in high pressure environments. Water is a natural choice to fill the space, but moisture can attack fiber optics, particularly under high pressure and at high temperatures. Materials which absorb moisture tend to re-release it at high temperatures. Materials which chemically react with moisture whether as a "getter" or as part of the curing process may mitigate this. Chemicals which absorb hydrogen are also of special interest. Use of liquid adhesive or the chemical(s) to activate an adhesive already applied to the umbilical may be a better choice. Also, a material which swells when exposed to a particular chemical may work. In these last two cases, it is important to make sure the reaction does not take place before the umbilical is in place, and that the fluid can get to most of the umbilical before the area around the umbilical is sealed.

Pumping in a heat set/cure material (or part of one or its catalyst) to both insert the umbilical and drive out air depends on finding a material with the right viscosity, as well as stretchability, material compatibility, and temperature rating, but gluing the umbilical to the coiled tubing over its length should create a tremendous seal.

An oil, grease, or gel fill is also possible, with hydrogen scavenging gel widely used in fiber optic systems.

Various optional accessories may be attached to the bottom of the coiled tubing 116 or umbilical 100, including but not limited to sensors such as a collar locator, gamma ray detector, or camera; a "tractor" to help pull the tubing 116 into position; a packer to anchor the bottom of the umbilical 100 or the tubing 116 at a specific place or isolate the sensors 112 from fluids or gasses; or a seismic source such as a vibrator or sparker. An accessory can also be used to inject or sample fluids. Many accessories are not mutually exclusive.

Pressure feedthroughs may be installed at top and bottom for needed fibers, wires, tubes, etc. Feedthroughs would allow these wires, fibers, hydraulics, etc., to exit the otherwise sealed assembly bottom. A "shoe" may protect the end of the assembly even if no other accessories are used.

The pressure feedthroughs prevent high pressure gasses/liquids in the well from blowing out through the coiled tubing 116. As such they should be rated to the pressure and temperature of the well. The feedthroughs can have bleed and fill ports to facilitate replacing air in the tubing with fluid, if applicable. A port on a feedthrough could be used for pressure testing the coiled tube assembly in the field. The top feedthrough can have a pressure gauge or sensor for monitoring the health of the coiled tubing; a sudden change in pressure could indicate a failure of the coiled tubing.

The feedthroughs (or equivalent connectors or plugs) should generally be connected to structural members of the umbilical to prevent settling of the umbilical from pulling out fibers, wires, etc.

The feedthroughs may also be associated with connectors which facilitate attachment of accessories or connection of multiple sensor strings together in the field, as when the necessary length of tubing cannot be placed on a single spool such as for size or weight reasons. (Coiled tubing spools can be larger in diameter than the clearance height of bridges and exceed the weight rating of bridges, cranes, and other infrastructure.)

If communication or power (i.e. optical, electrical, and hydraulic) for an accessory is not necessary then a plug or connector without a feedthrough may be used for the bottom end.

The top feedthrough may not be necessary (as a pressure bulkhead) in some applications.

In the field, the top end fibers, wires, cables, tubes, etc., are connected to their respective top side instruments, supplies, or equipment. ("Top side" could be underwater or underground, but is at the control end for the purpose of the invention.)

Figure 2:
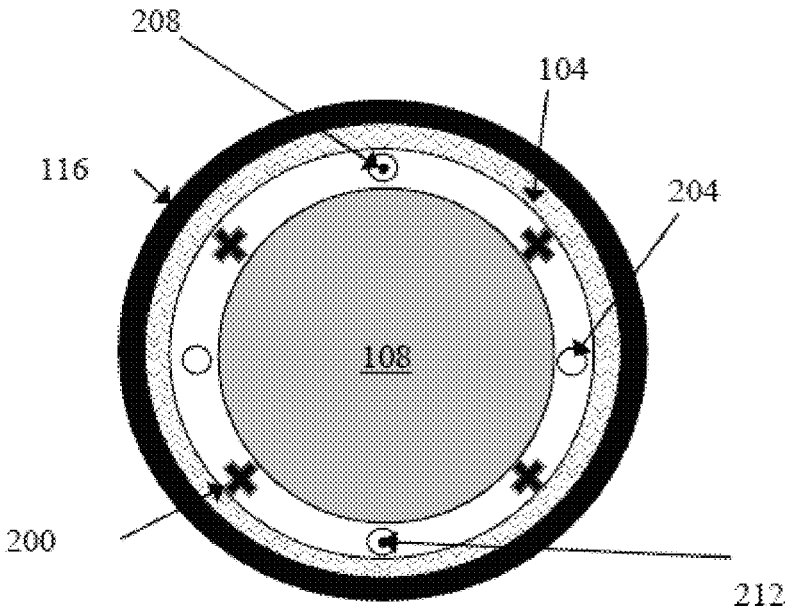
FIG. 2 shows a cross-section of the umbilical of FIG. 1A deployed in the tubing of FIG. 1B.

FIG. 2 shows a cross section of the umbilical of FIG. 1A deployed inside the coiled tubing of FIG. 1B. That is, FIG. 2 shows a cross-section of the assembly FIG. 1C.

As shown, the coiled tubing 116 surrounds the umbilical 100. Sensing fibers 200 and conduits 204 are placed around the core 108 in the encapsulant layer 104. The core 108 has spaces to accommodate sizeable sensors 112 such as accelerometers or geophones (not shown in FIG. 2). The conduits 204 may be used to accommodate smaller sensors such as, e.g., sensing fibers 208 or support fibers 212, wiring, tubing, etc.

In embodiments utilizing one or more distributed sensing fibers 200, the fibers 200 may provide directional or non-directional seismic, acoustic, pressure, or temperature sensing. The coiling or helixing of the fibers 200 may be used to control the sensitivity and/or the directionality of the sensing. A plurality of fibers 200 may be used to increase sensitivity relative to that of a single fiber 200.

To minimize the diameter (i.e., cost) of the coiled tubing 116 it is typically desirable to place sensors 112 along the length dimension of the coiled tube 116. In the prior art, a rigid framework holds the, e.g., geophones or accelerometers at the correct angles relative to each other. However, a long, straight assembly could be damaged or break the coiled tubing 116 or the umbilical 100 as the tubing and umbilical are bent when spooling and unspooling as part of fabrication or deployment. Accordingly, various embodiments of the invention may utilize a sensor array in the place of a sensor 112, with the array connected by elements which allow flexion but not rotation.

Figure 3:
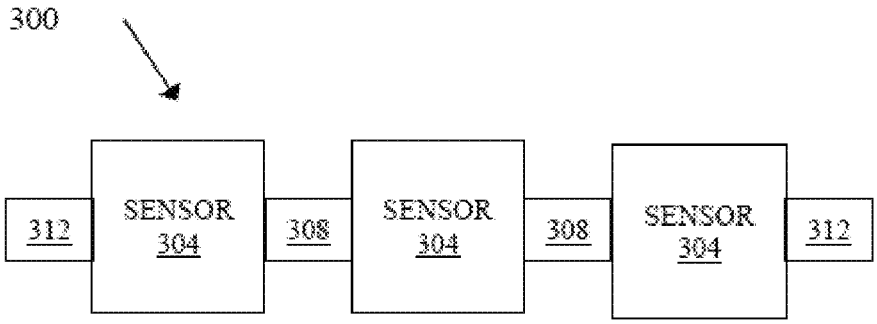
FIG. 3 shows one embodiment of a sensor array suitable for use in a sensing umbilical.

FIG. 3 shows one embodiment of such a sensor array 300 for placement in an umbilical 100 having individual sensors 304 attached to each other with flex joints 308 and attached to the core at mounting points 312. These sensors 304, such as accelerometers and geophones, typically require specific relative orientations beyond the capability of the core of itself. The sensors 304 may or may not have pressure housings and may be shapes other than cylindrical.

In this embodiment, three-component ("3C") sensors provide two horizontal and one vertical axis (i.e., "x," "y," and "z"), with these sensors being mutually orthogonal in three dimensions. Examples of flex joints 308 that may be used in various embodiments include flex shafts, universal joints, bellows, springs, flexures, ball/knuckle joints, or a universal joints.

As would be apparent to one of ordinary skill, this configuration in FIG. 3 using flex joints 308 permits the sensors 304 to move relative to each other as the umbilical 100 is coiled and uncoiled while preserving their relative orientation on at least one axis, i.e., such that an "x" sensor is prevented from rotating in a plane relative to a "y" sensor but allows "z" sensor to rotate so long as it is approximately orthogonal to "x" and "y" sensors.

The sensors 304 can be attached to the core 108 at appropriate mounting points 312. For a tubular core 108, possibly containing fibers, wires, or hydraulic fluid, the mount points 312 could be hose barbs or flare fittings. For a core 108 made of an aramid, fiberglass, or carbon fiber fabric the mount points 312 could be surfaces to clamp or laminate the fabric to. For solid cores 108, the mount points 312 could be surfaces or sockets to glue or weld the core 108 to, possibly requiring notching or tapering to preserve the outer diameter. For a steel cable core 108, the mount points could be rope sockets. The mount points 312 may also contain fiber management areas.

If, once deployed, the tubing 116 or the umbilical 100 does not straighten out enough for the sensors 304 to be effectively orthogonal the misalignment can be corrected later in software based on knowing the locations of a number of sources. This is similar to establishing the orientation of a sensor on a wireline which is free to rotate and may be clamped against a well section which is not fully vertical. Instrumentation of the joints 308 to measure the angles between the sensors 304 is also possible using, e.g., sensors (not shown) attached to the x, y, and z sensors 300.

Figure 4:
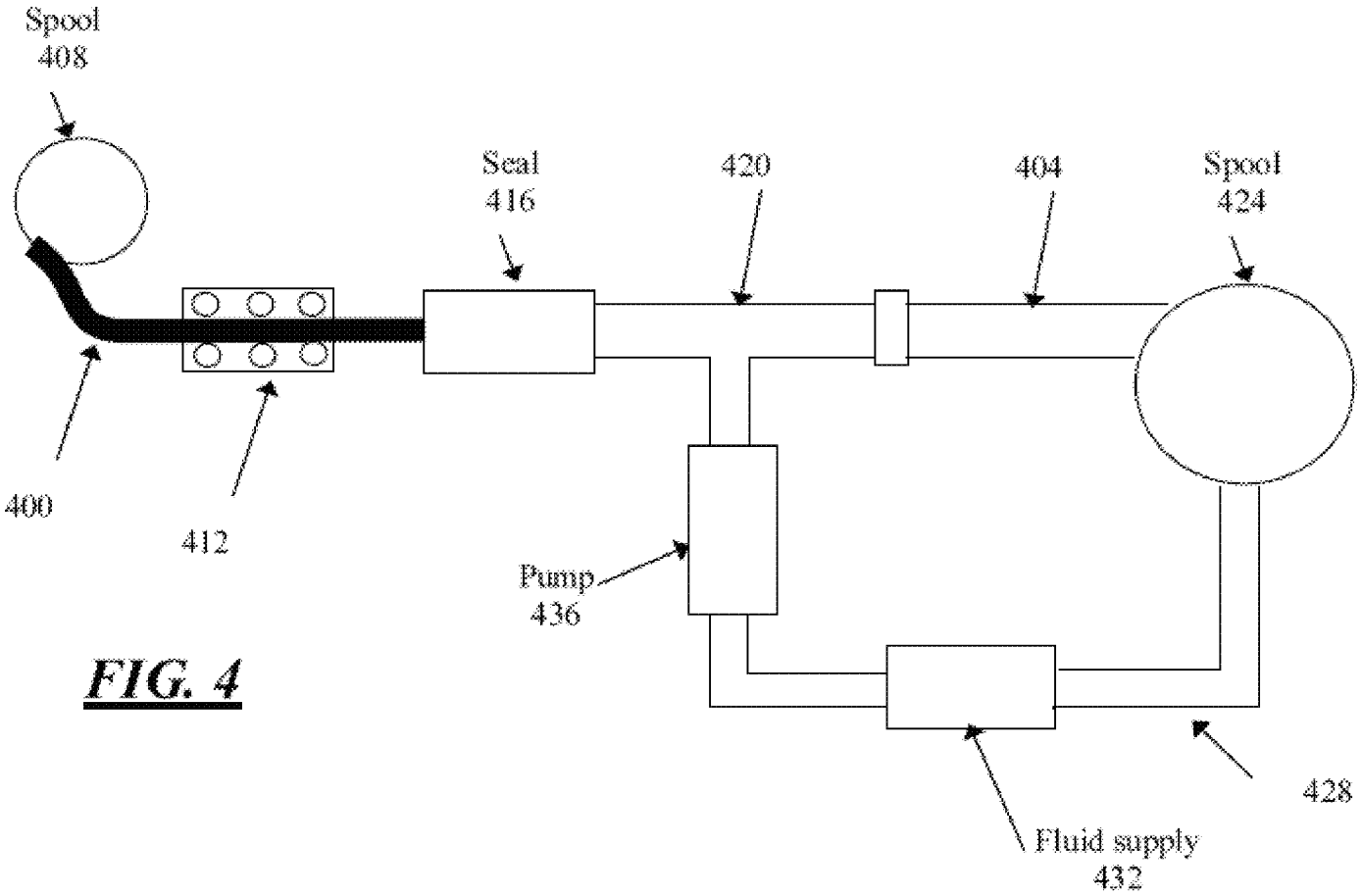
FIG. 4 shows an apparatus for deploying a sensing umbilical in coiled tubing.

FIG. 4 shows a system for injecting the umbilical 400 into coiled tubing 404. The spool 408 holding the umbilical 400 feeds the umbilical 400 to a drive system 412 which provides compressive force or tension as needed to control the speed of the insertion of the umbilical 400 into the environmental seal 416. At the "Y"-junction 420 fluid (e.g., water or another fluid) pumped around the umbilical 400 helps to carry the umbilical 400 into the coiled tubing 404 while it is coiled around its spool 424. A return loop 428 returns the fluid exiting the coiled tubing 404 to the fluid supply 432. The pump 436 controls the fluid speed and direction.

There are many other prior art techniques for loading an umbilical into coiled tubing, such as laying the tubing on the ground so a umbilical can be pushed/pulled/blown into the tubing; and putting the tubing down a well so the umbilical can be fed with the benefit of gravity. Other techniques related to inserting umbilicals into coiled tubing while it is still coiled using fluid, gas, pushing, and pulling. The most appropriate method may depend on the length of the coiled tubing.

Figure 5:
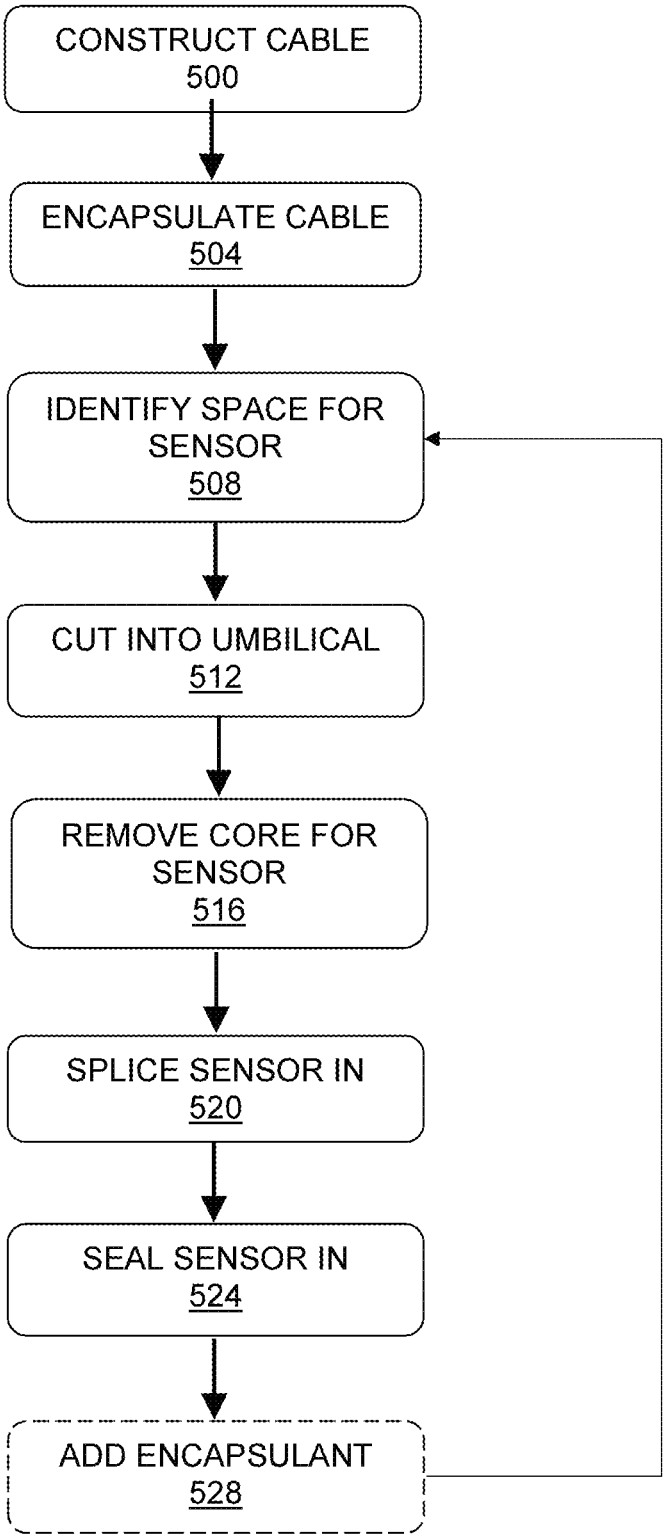
FIG. 5 is a flowchart of a method for manufacturing a sensing umbilical.

FIG. 5 is a flowchart showing one method for manufacturing a sensing umbilical in accord with the present invention. First, the cable is constructed with the necessary fiber, wire, tubing, and conduits around an inner core which serves as a strength member or filler (Step 500) and the cable is encapsulated with one or more layers of opaque, transparent, or translucent material (e.g., plastic, tape, etc.) so the fibers, wires, etc., which may be color coded, can be seen or otherwise located through the encapsulant (Step 50)., This process can be repeated to add an arbitrary number of layers of fiber, wire, tubing, conduits, etc. and encapsulants.

Now, for each sensor to be installed in the umbilical: identify a location for the sensor in the cable (Step 508); cut into the umbilical so only the fibers, wires, tubes, cables, etc., necessary to support the sensor(s) for this location are disturbed (Step 512); expose a section of the core and remove enough of it to make space for the sensor (Step 516); splice in the sensor (optically, mechanically, electrically, etc.) (Step 520); seal the sensor in place using, e.g., potting or injection molding, such that the cable is sufficiently sealed for subsequent processing (Step 524), and optionally apply a top coat of plastic or other material to ensure a good seal and a sufficiently uniform dimension around the sealed umbilical (Step 528). In some embodiments, sealing individual sensors (Step 524) can be foregone if the entire umbilical is covered with encapsulant (Step 528).

"Potting" (Step 520) is analogous to "potting a plant," i.e., filling the space around the sensor with adhesive or filler material to ensure good contact between the sensor and the material around it. This step may or may not use a mold or pressure. If the umbilical will be fluid filled or will be used only in low pressure environments, this step may not be necessary.

Additional layers can be applied to build out the umbilical with additional fibers, wires, cables, tubes, or the like, and structural or protective layers like armor, chemical resistant seals, chemically reactive seals (i.e. water block,) structural support, an adhesive or part thereof, or low friction relative to coiled tubing. The sealing step (Step 524) can be deferred until any additional layers are added.

Once the umbilical has been manufactured, it can be injected into coiled tubing using a pumped fluid and an apparatus such as the one in FIG. 4. Pressure feedthroughs can be installed in the coiled tubing at the top and bottom for fibers, wires, etc. as discussed above.

In another embodiment, a sensing umbilical could be manufactured by encapsulating a wireline array with thermoplastic or silicone to build it up to a uniform dimension which can then be injected into coiled tubing as described above.

As evidenced by the foregoing discussion, embodiments of the present invention are suitable for a variety of seismic monitoring applications, including but not limited to the deployment of long-term (permanent and semi-permanent) scalable seismic systems (including producing wellbores) for offshore and land reservoirs; locally un-manned system operations which reduce HSE (Health, Safety, Environmental) exposure and cost; semi-permanent, scalable multi-well seismic systems (including producing wellbores) for offshore and land reservoirs; and retrievable seismic systems (including producing wellbore) for exploration and development.

Other applications include long-term (permanent and semi-permanent) thermal and pressure monitoring/surveillance, microseismic event detection, episodic seismic imaging (time-lapse,) oilfield intrusion detection, and rapid deployment and retrieval applications.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A sensing umbilical for use in a borehole, the umbilical comprising:

a single-piece core having at least one sensor disposed in a space within the single-piece core, at least part of the single-piece core being continuous despite the space containing the sensor;

at least one supporting connection for the at least one sensor; and an encapsulant external to the core.

2. The umbilical of claim 1 wherein the diameter of the core is the size of the at least one sensor.

3. The umbilical of claim 1 wherein the at least one supporting connection is at least one of an electrical connection and an optical connection.

4. The umbilical of claim 1 wherein the at least one supporting connection is contained in a conduit or capillary.

5. The umbilical of claim 1 further comprising at least one distributed sensing fiber located in a conduit or capillary.

6. The umbilical of claim 1 wherein the core is fabricated from a material selected from the group consisting of plastic, aramid, carbon fiber, fiberglass, and steel.

7. The umbilical of claim 1 wherein the encapsulant is transparent.

8. The umbilical of claim 1 wherein the at least one sensor is a plurality of sensors, at least some of the plurality of sensors interconnected by mounts that allow flexion but not rotation.

9. The umbilical of claim 1 wherein the at least one sensor is attached to the core with at least one mount point.

10. The umbilical of claim 1 inside coiled tubing.

* * * * *